US012662814B2

(12) United States Patent
Heesbeen et al.

(10) Patent No.: US 12,662,814 B2
(45) Date of Patent: Jun. 23, 2026

(54) GRID OF PROFILES AND METHOD FOR DISMOUNTING A GRID OF PROFILES

(71) Applicant: SAINT-GOBAIN ECOPHON AB, Hyllinge (SE)

(72) Inventors: Jan-Dirk P Heesbeen, Amersfoort (NL); Duygu Guroglu, Amersfoort (NL)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 172 days.

(21) Appl. No.: 18/574,835

(22) PCT Filed: Jun. 14, 2022

(86) PCT No.: PCT/EP2022/066161
§ 371 (c)(1),
(2) Date: Dec. 28, 2023

(87) PCT Pub. No.: WO2023/274716
PCT Pub. Date: Jan. 5, 2023

(65) Prior Publication Data

US 2024/0301692 A1 Sep. 12, 2024

(30) Foreign Application Priority Data

Jul. 1, 2021 (EP) ..... 21183147

(51) Int. Cl.
*E04B 9/12* (2006.01)
*E04B 9/06* (2006.01)

(52) U.S. Cl.
CPC ..... *E04B 9/127* (2013.01); *E04B 9/067* (2013.01)

(58) Field of Classification Search
CPC ..... E04B 9/127; E04B 9/122; E04B 9/068
See application file for complete search history.

(56) References Cited

U.S. PATENT DOCUMENTS 3,015,375 A * 1/1962 Lickliter ..... E04B 9/122 403/219
3,189,139 A 6/1965 Znamirowski et al.
3,286,427 A * 11/1966 Cotter ..... E04B 9/122 403/219
3,321,879 A * 5/1967 Purdy ..... E04B 9/122 52/506.07
3,457,688 A * 7/1969 Znamirowski ..... E04B 9/10 403/219
3,680,711 A * 8/1972 Brucker ..... E04B 9/122 52/632

(Continued)

FOREIGN PATENT DOCUMENTS

EP 1703034 A1 9/2006
GB 1154560 A 6/1969

OTHER PUBLICATIONS

International Search Report issued in corresponding International Patent Application No. PCT/EP2022/066161 dated Sep. 28, 2022.

*Primary Examiner* — Gisele D Ford
(74) *Attorney, Agent, or Firm* — Morgan, Lewis & Bockius LLP

(57) ABSTRACT

The present disclosure relates to a grid of profiles for a suspended ceiling system, comprising a primary profile having a web, and a first and second secondary profile each having an end provided with a hook-on member, and methods of use thereof.

16 Claims, 4 Drawing Sheets

(56) References Cited

U.S. PATENT DOCUMENTS

| | | | | | |
|---|---|---|---|---|---|
| 3,746,379 | A * | 7/1973 | Sauer | F16B 7/0486 | 403/247 |
| 3,921,363 | A * | 11/1975 | Beynon | E04B 9/122 | 403/219 |
| 4,079,564 | A * | 3/1978 | Ollinger | E04B 9/127 | 403/244 |
| 4,106,878 | A * | 8/1978 | Jones | E04B 9/14 | 52/664 |
| 4,264,231 | A * | 4/1981 | Rosenbaum | E04B 9/122 | 52/667 |
| 4,364,686 | A * | 12/1982 | Sharp | E04C 2/421 | 52/667 |
| 5,137,390 | A * | 8/1992 | Felsen | E04B 9/122 | 403/393 |
| 5,761,868 | A * | 6/1998 | LaLonde | E04B 9/122 | 52/506.07 |
| 5,893,249 | A * | 4/1999 | Peterson | F16B 7/0486 | 52/506.07 |
| 5,966,887 | A * | 10/1999 | Mieyal | E04B 9/122 | 52/506.07 |
| 7,490,446 | B1 * | 2/2009 | Chuang | E04B 9/127 | 52/232 |
| 9,637,918 | B1 * | 5/2017 | Carbajal | E04B 9/122 | |
| 2013/0061550 | A1 * | 3/2013 | Underkofler | E04F 13/0803 | 52/698 |
| 2016/0251855 | A1 * | 9/2016 | Heesbeen | E04B 9/067 | 52/506.05 |
| 2022/0275642 | A1 * | 9/2022 | Heesbeen | E04B 9/16 | |
| 2023/0056851 | A1 * | 2/2023 | Nilsson | E04B 9/122 | |

* cited by examiner

GRID OF PROFILES AND METHOD FOR DISMOUNTING A GRID OF PROFILES

FIELD OF THE INVENTION

The present invention relates to suspended ceiling systems and more particularly to a grid of profiles for a suspended ceiling system and to a method for dismounting a grid of profiles for a suspended ceiling system.

BACKGROUND ART

Suspended ceiling systems are used in many different types of buildings e.g. to lower the ceiling height, to provide sound dampening, to facilitate mounting of light sources and other building equipment and to provide an aesthetically pleasing interior ceiling. Suspended ceiling systems, as the name implies, are attached to a supporting structure of some sort, such as the structural ceiling of the building. Suspended ceiling systems usually comprises a plurality of ceiling tiles and a supporting structure in form of a grid of profiles. The grid of profiles commonly comprises profiles it the form of main runners forming the structural, load bearing structure of the grid which are connected to the ceiling. The main runners are moreover often interconnected by profiles in the form of cross runners, which are connected to the main runners and together forms a grip pattering into which for instance ceiling tiles can be arranged.

The ceiling tiles may have sound-absorbing and/or sound-insulating properties in order to improve the acoustic environment of the room. In order to obtain a lightweight ceiling with satisfactory sound absorption, the tiles, for instance, may be made of a compressed fibre material such as mineral wool and especially glass wool. In addition to ceiling tiles, the profiles may also support various equipment such as lighting devices, ventilation equipment, inspection openings, detectors, cable trays, loudspeakers, signs, sprinklers etc.

Manufacturers of suspended ceiling systems continuously strive to improve the safety of the systems and, as with other equipment that is installed in public/residential buildings, suspended ceilings systems are subject to a number of safety requirements to be fulfilled for instance in case of fire. Moreover, facilitating mounting and demounting of the suspended ceiling systems is another area under constant development.

Relevant prior art may be found in EP1703034A1.

SUMMARY OF THE INVENTION

To achieve at least one of the above objects and also other objects that will be evident from the following description, a grid of profiles and a method for dismounting a grid of profiles is provided.

More specifically, there is provided according to a first aspect of the present invention a grid of profiles for a suspended ceiling system. The grid of profiles comprising

- a primary profile having a web provided with a connection opening, and
- a first and second secondary profile each having an end provided with a hook-on member. The first and second secondary profiles are connected to the primary profile by means of the hook-on members which are inserted into the connection opening from opposite sides thereof for hooked engagement with the web of the primary profile. The first and second secondary profiles each comprises a lug extending in the longitudinal direction of the associated first or second secondary profile, which lugs cooperate with the primary profile to define a mounted state of the grid of profiles. Each lug is configured for deformation against the primary profile in response to a thermally induced longitudinal expansion of the associated first or second secondary profile. The grid of profiles is settable to a dismounting state in which the primary profile is twistable about an axis parallel with the longitudinal direction thereof for disconnection of one of the first and second secondary profile, wherein each lug is movable to a deflected position and the grid of profiles is configured to assume the dismounting state in response to moving at least one of the lugs to the deflected position. The lug on each of the first and second secondary profiles is moveable around a folding axis being arranged at angle in relation to the longitudinal direction of the respective first and second secondary profile, wherein the angle is between 15° and 80°, preferably 45°.

A grid of profiles is thus provided which facilitates dismounting by allowing the primary profile to be twisted, as permitted by the deflection of the lug on at least one of the first and second secondary profiles. The lug can subsequently be returned to the undeflected position thereby enabling re-insertion of the hook-on member into the connection opening in the primary profile whereby the lug defines the mounted state of the grid. The dual functionality of the lug further facilitates that the grid of profiles can meet the requirements of withstanding high temperatures, for instance in the case of a fire, by allowing the lugs to absorb the longitudinal expansion of the secondary profiles.

The primary profile may be formed by a main runner or by a cross runner of the grid of profiles.

Moreover, the lug on each of the first and second secondary profiles is moveable around a folding axis being arranged at angle in relation to the longitudinal direction of the respective first and second secondary profile. The degree with which the primary profile can be twisted can thus be increased, facilitating extraction of the first and/or second secondary profile from the connection opening of the primary profile.

The lug on each of the first and second secondary profiles may extend at an angle in relation to the longitudinal direction of the each of the first and second secondary profile. The lug may extend essentially perpendicularly to the folding axis of the lug. The lug may extend from the web of the secondary profile.

The hook-on member on each of the first and second secondary profile on an upper edge thereof may further comprise a recess configured to accommodate the primary profile as it is twisted, further facilitating extracting the first and/or second secondary profile from the primary profile.

The recess may at a side thereof configured to be arranged closest to the primary profile in the mounted state of the grid of profiles comprise an inclined surface.

The respective lug and/or hook-on member may be integrally formed with the first and second secondary profiles respectively.

The lug on each of the first and second secondary profiles may be configured to cooperate with a bulb portion of the primary profile to define a mounted state of the grid of profiles.

The lug may be arranged above the hook-on member on each of the first and second secondary profile.

The lug may be arranged below the hook-on member on each of the first and second secondary profile.

In a second aspect of the present disclosure is a method for dismounting a grid of profiles for a suspended ceiling system provided. The grid of profiles comprising a primary profile having a web provided with a connection opening, and a first and a second secondary profiles each having an end provided with a hook-on member. The first and second secondary profiles are connected to the primary profile by means of the hook-on members which are inserted into the connection opening from opposite sides thereof for hooked engagement with the web of the primary profile. The first and second secondary profiles each comprises a lug extending in the longitudinal direction of the associated first or second secondary profile, which lugs cooperate with the primary profile to define a mounted state of the grid of profiles. Each lug is configured for deformation against the primary profile in response to a thermally induced longitudinal expansion of the associated first or second secondary profile. The grid of profiles is settable to a dismounting state in which the primary profile is twistable about an twisting axis parallel with the longitudinal direction thereof for disconnection of one of the first or second secondary profile, and each lug is movable to a deflected position. The method comprises moving at least one of the lugs to the deflected position,
twisting the primary profile about the twisting axis, and
extracting the hook-on member of one of the first or second secondary profiles out of the connection opening of the primary profile for disconnecting the one of the first or second secondary profile from the primary profile.

The provided method facilitates dismounting by the twisting of the primary profile, as permitted by the deflection of the lug on at least one of the first and second secondary profiles. The lug can subsequently be returned to the undeflected position thereby enabling re-insertion of the hook-on member into the connection opening in the primary profile whereby the lug defines the mounted state of the grid.

Moving at least one of the lugs to the deflected position may further comprise moving the lug on the one of the first and second secondary profile that is extracted from the primary profile, facilitating extracting a secondary profile having the lug arranged below the hook-on member from the connection opening.

Moreover, moving at least one of the lugs to the deflected position May comprise moving the lug on the one of the first and second secondary profile that is not extracted from the primary profile, facilitating extracting a secondary profile having the lug arranged above the hook-on member from the connection opening.

Moreover, moving at least one of the lugs to the deflected position May comprise moving the lug around a folding axis being arranged at angle in relation to the longitudinal direction of the respective first and second secondary profile, wherein the angle is between 15° and 80°, preferably 45°.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
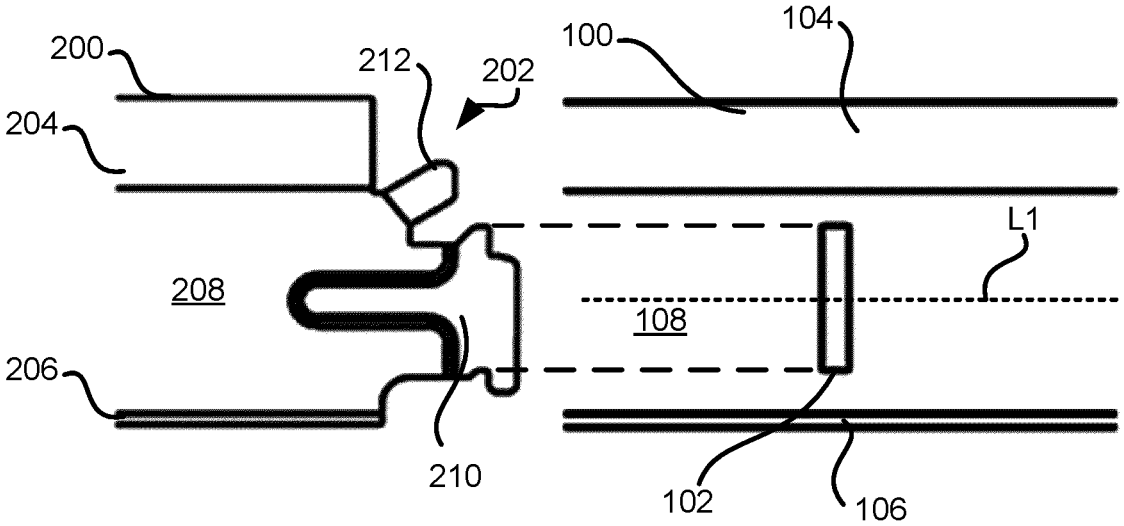
FIG. 1 discloses a side view of secondary profile and of a primary profile.

FIG. 1 discloses a side view of an end 202 of a secondary profile 200 and a side view of a primary profile 100.

The primary profile 100 may constitute a main runner in a grid of profiles and the secondary profile 200 may constitute a cross runner connectible to the main runner. Alternatively, the primary profile 100 may constitute a cross runner in a grid of profiles to which primary profile 100 the secondary profile 200 is connectible.

To the right in FIG. 1 is the primary profile 100 seen from a side view with a connection opening 102 being visible. In the context of the present disclosure, a primary profile 100 is to be seen as the profile in a grid of profiles 10 which is connected/suspended to/from a supporting structure, such as a structural ceiling of the building in which the grid of profiles 10 is arranged. One or more secondary profiles 200, shown to the left in FIG. 1, are in turn connected to and/or suspended from the primary profile 100. Preferably, the primary and secondary profiles 100, 200 are configured to be perpendicularly arranged in relation to one another to form the grid of profiles 10 which can support for instance ceiling tiles and/or equipment such as ventilation devices, light sources etc.

However, it is also conceivable that the secondary profile 200 is also connected/suspended to/from the supporting structure.

The primary profile 100 and the secondary profile 200 is preferably an elongated metal profile, which may be manufactured by roll-forming from a sheet material. However, the primary profile 100 and the secondary profile 200 may also be a plastic profile manufactured for instance by means of extrusion or another suitable manufacturing process.

The primary profile is provided with a web 108 in which the connection opening 102 is arranged. A plurality of connection openings 102 may be provided along the length of the primary profile 100, for instance arranged with a predetermined distance between every two connection openings 102 which may be adapted after the size of the associated ceiling tiles. The connection opening 102 is arranged in a web 108 of the primary profile 100.

The primary profile 100 may have an inverted T-shaped profile with an upstanding web 108 and laterally extending flanges 106 and a bulb portion 104 arranged at the free end of the web 108.

The secondary profile 200 may further have an inverted T-shaped profile with an upstanding web 208 and laterally extending flanges 206 and a bulb portion 204 arranged at the free end of the web 208.

As is further shown in FIG. 1, the secondary profile 200 is provided with an end 202 having a hook-on member 210. A hook-on member 210 may be arranged at both ends of the secondary profile 200. The hook-on member 210 may further in addition be configured for snap-locking engagement in the connection opening 102 and/or with the hook-on member 210 of an opposite meeting secondary profile 200.

The hook-on member 210 is preferably integrally formed with the secondary profile 200 but may also formed as a separate part and be attached to the secondary profile 200 for instance by welding or by means of a suitable mechanical fastener such as one or more rivets etc.

Figure 2:
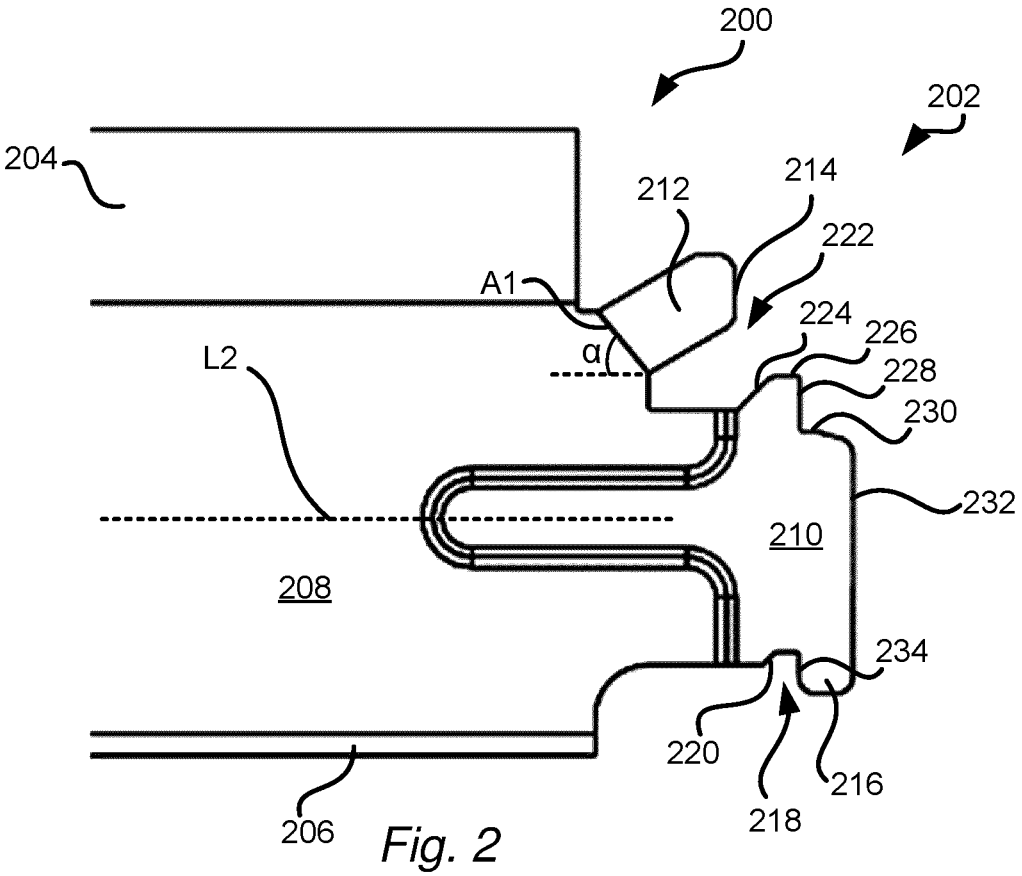
FIG. 2 discloses a side view of a secondary profile.

In the following will reference be made simultaneously to FIG. 1 and FIG. 2, FIG. 2 shows the end 202 of a secondary profile 200 in a side view. The hook-on member 210 is configured for hooked engagement with the web 108 of the primary profile 100 and, as is illustrated by the two dashed lines in FIG. 1, is adapted such that a height of the hook-on member 210 essentially corresponds to a height of the connection opening 102. The vertical distance between an upper surface 226 and a bottom surface of a hook recess 218 of the hook-on member 210 is preferably essentially corresponding to the height of the connection opening 102. The upper surface 226 prevents that each secondary profile 200 can be lifted vertically in relation to the primary profile 100 and thus be unintentionally disconnected, as the upper surface 226 will come into contact with the connection opening 102 before the hook-on member 210 can be removed from the connection opening 102.

Figure 5:
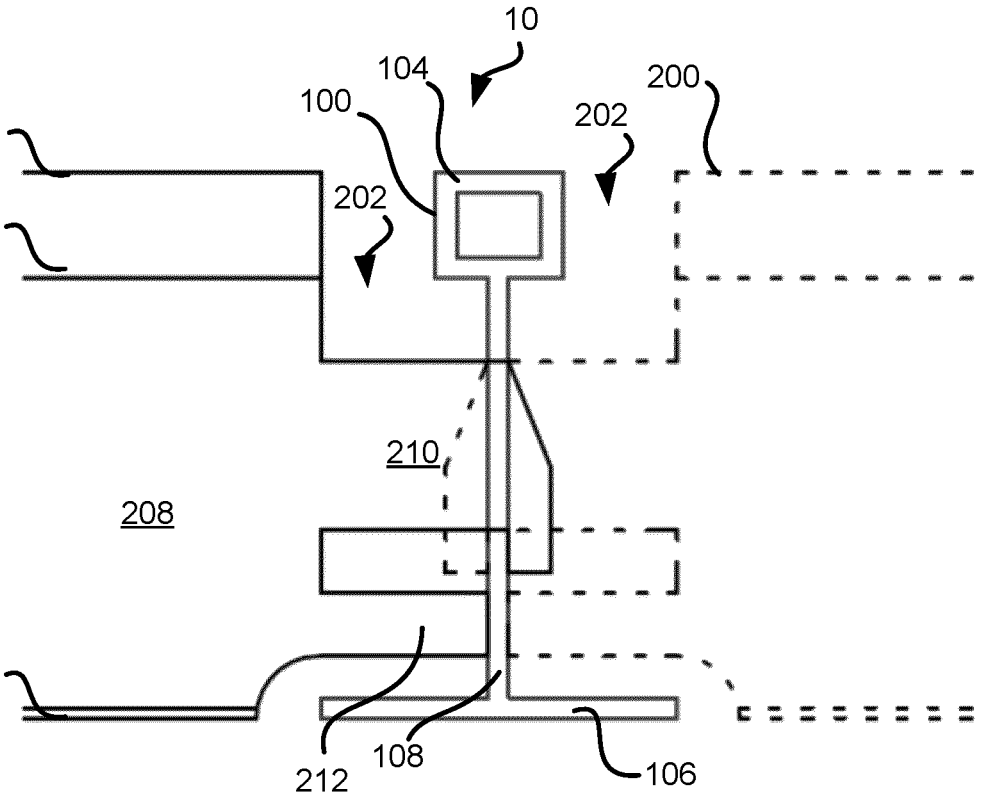
FIG. 5 discloses a grid of profiles in a mounted state.
Figure 6:
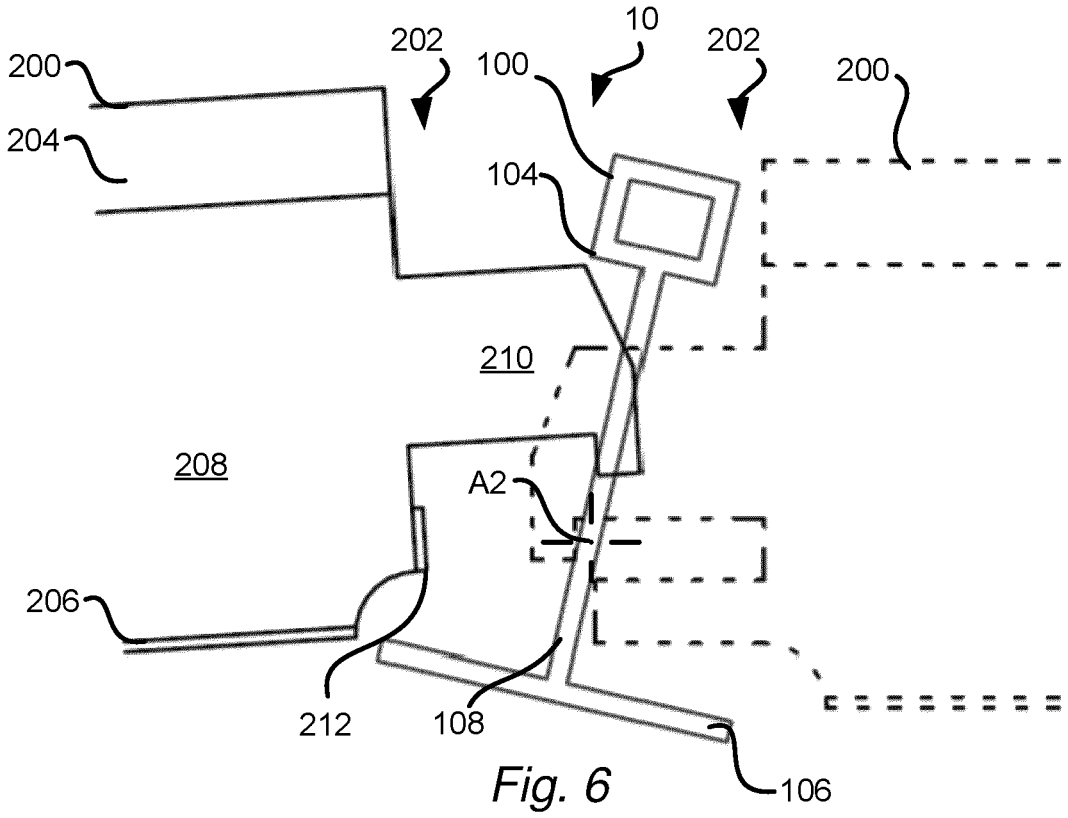
FIG. 6 discloses a grid of profiles in a dismounting state in which the primary profile is twisted.

The secondary profile 200 further comprises a lug 212 extending in the longitudinal direction L2 of the associated secondary profile 200. The lug 212 may as is shown FIG. 1 extend in the longitudinal direction L2 and also in an upwardly direction, i.e. at an angle in relation to the longitudinal direction L2. Preferably, the lug 212 extends in the plane of the web 208 of the secondary profile 200. The lug 212 is configured to cooperate with the primary profile 100 to define a mounted state of the grid of profiles 10. The lug 212 may comprise an abutment surface 214 configured to cooperate with the primary profile 100 and thus to define the mounted state of the grid of profiles 10. Preferably, the lug 212 is configured to cooperate with the bulb portion 104 of the primary profile 100. As is illustrated in FIGS. 1 and 2, the lug 212 may be arranged above the hook-on member 210. However, as is illustrated in FIGS. 5 and 6, the lug 212 may alternatively be arranged below the hook-on member 210.

The lug 212 is configured for deformation against the primary profile 100 in response to a thermally induced longitudinal expansion of the associated first or second secondary profile 200. Such a thermally induced longitudinal expansion may for instance be caused by fire. The longitudinal expansion of secondary profile 200 can thus be accommodated without subjecting the primary profile 100 or other components of the grid of profiles 10 to excessive forces that could risk the integrity of the grid 10.

The hook recess 218 is configured to receive the bottom of the connection opening 102 and thus the web 108 of the primary profile 100. In order to facilitate positioning of the hook-on member 210, the hook recess 218 may comprise an inclined surface 220 at proximal end of the hook recess 218. The inclined surface 220 cooperates with the connection opening 102, whereby the hook-on member 210 will slide against the web 108 of the primary profile 100 such that the web is arranged in the hook recess 218.

In the present disclosure, distal is to be interpreted as closer to the end 202 of the secondary profile and proximal as further from the end 202 of the secondary profile.

The hook-on member 210 is preferably arranged such that web 108 of the primary profile 100 is arranged in the proximity of or in contact with a distal surface 234 in the hook recess 218. The distal surface 234 extends essentially vertically and forms a proximal side of a hook protrusion 216. The hook protrusion 216 extends in a downwardly direction and is configured to be arranged on the opposite side of the web 108 in relation to the remainder of the associated secondary profile 200 and is configured to hookingly lock against the web 108 to prevent the secondary profile 200 from being disconnected from the primary profile 100 by a horizontal force in the longitudinal direction L2 of the secondary profile 200.

The lug 212 and the hook recess 218 may thus together be configured to define connected state of each secondary profile 200 with the primary profile 100, where the lug 212 defines the position of the secondary profile 200 in an insertion direction and the hook recess 218 defines the position in an extraction direction of the hook-on member 210. It is also feasible that only the lug 212 and/or the hook recess 218 defines the positioning of the hook-on member 210 in relation to the primary profile 100.

The hook-on member 210 may further comprise a distal surface 232 forming the distal end of the secondary profile 200. The distal surface 232 extends vertically from the hook protrusion 216 and transitions gradually into a horizontal surface 230, the horizontal surface 230 extending in the proximal direction from the distal surface 232. The horizontal surface 230 may at a proximal side thereof connect to a vertical surface 228 that extends to the upper surface 226 of the hook-on member 210.

The upper surface 226 preferably extends essentially horizontally.

The hook-on member 210 may further comprises an upper recess 222, the upper recess 222 being configured to accommodate the primary profile 100 when the primary profile 100 is twisted, as will be elaborated further on below.

The upper recess 222 may at a side thereof configured to be arranged closest to the primary profile 100 in the mounted state of the grid of profiles 10, i.e. at a distal side, comprise an inclined surface 224. The inclined surface 224 may connect the recess 222 with the upper surface 226 of the hook-on member 210.

Figure 3:
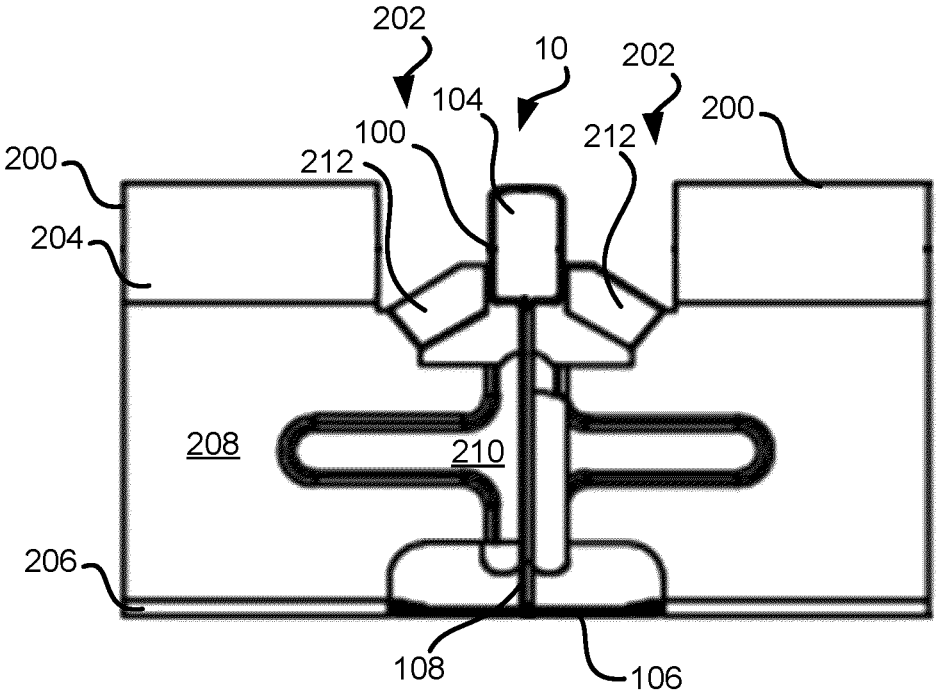
FIG. 3 discloses a grid of profiles in a mounted state.
Figure 4:
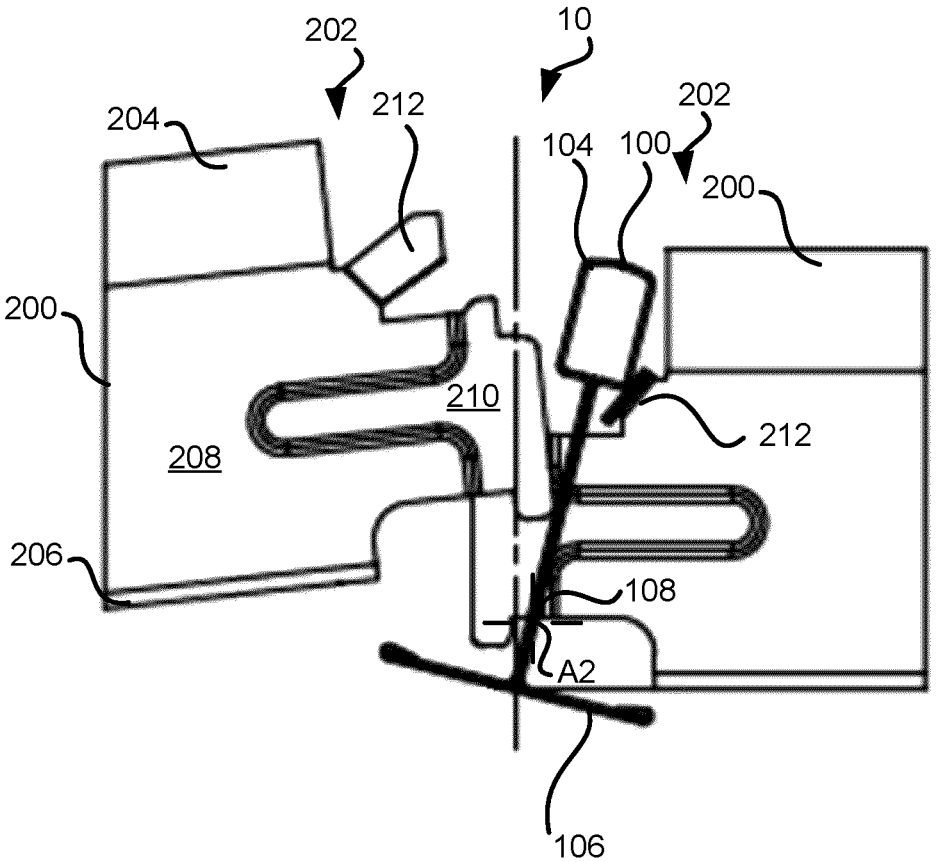
FIG. 4 discloses a grid of profiles in a dismounting state in which the primary profile is twisted.

The grid of profiles 10 disclosed herein is further settable to a dismounting state in which the primary profile 100 is twistable about an axis A2 parallel with a longitudinal direction L1 thereof for disconnection of the secondary profile 200, i.e. one of the first and second secondary profiles 200, as is illustrated in FIGS. 3 and 4.

This is achieved as the lug 212 is movable to a deflected position, whereby the grid of profiles 10 is configured to assume the dismounting state in response to moving the lug 212 to the deflected position. The lug 212 may be returned from the deflected position once the secondary profile 200 is disconnected from the primary profile 100.

The lug 212 may be moveable around a folding axis A1 being arranged at angle $\alpha$ in relation to the longitudinal direction L2 of the respective first and second secondary profile 200. The angle α being between 15° and 80°, preferably 45°. The folding axis a being arranged at an angle facilitates moving the lug 212 into the deflected position as it is easy to access for a person disconnecting the grid of profiles 10. Further still, it facilitates deflecting the lug 212 such that the lug 212 does not interfere the twisting of the primary profile 100. The angled folding axis A1 allows a larger degree of twisting of the primary profile 100 before the bulb portion 104 thereof abuts against the deflected lug 212, as illustrated in FIG. 4.

In FIG. 3, the grid of profiles 10 is shown in a mounted state. The first and second secondary profiles 200 are connected to the primary profile 100, preferably in essentially perpendicular orientation thereto. It is to be realized that the grid of profiles 10 may comprise more than two secondary profiles 200 and more than one primary profile 100. The first and the second secondary profiles 200 are each provided with identical ends 202, and the description of features in relation to FIGS. 1 and 2 are thus equally applicable to both the first and second secondary profile 200. The first and second secondary profiles 200 may however have different lengths.

The first and second secondary profile 200 is each arranged with the hook-on member 210 securely arranged in the connection opening 102 of the primary profile 100, i.e. in the mounted state. The lug 212 of each secondary profile 200 is arranged in the proximity of the primary profile 100, specifically in the proximity and cooperating of the bulb portion 104 thereof. The lug 212 of at least one of or each of the first and second secondary profile 200 may be abutting against the bulb portion 104 of the primary profile 100 in the mounted state.

In FIG. 4, the grid of profiles 10 is shown in its dismounting state in which the lug 212 of one of the first and second secondary profiles 200 is deflected. Each of the secondary profiles 200 is provided with a lug 212 arranged above the hook-on member 210, the lug 212 is thus deflected on the one of the first and second secondary profile 200 that is not dismounted from the primary profile 100. This allows the primary profile 100 to be twisted such that the hook-on member 210 can be lifted clear from the connection opening 102. Naturally however, the lugs 212 on both secondary profiles 200 may be deflected. Moreover, in case grid of profiles 10 comprises a primary profile 100 having several connection openings 102 and thus a plurality of secondary profiles 200 along its length, the procedure of deflecting the lug 212 as explained herein may be performed for some or all of the secondary profiles 200 connected to each of the connection openings 102 along the entire length of the primary profile 100 depending on the torsional stiffness of the primary profile 100. A low torsional stiffness of the primary profile may enable twisting of just a section of the primary profile for disconnection of a secondary profile connected to the primary profile in that section, in which case it may not be necessary to deflect all lugs for enabling disconnection of the secondary profile.

Figure 7:
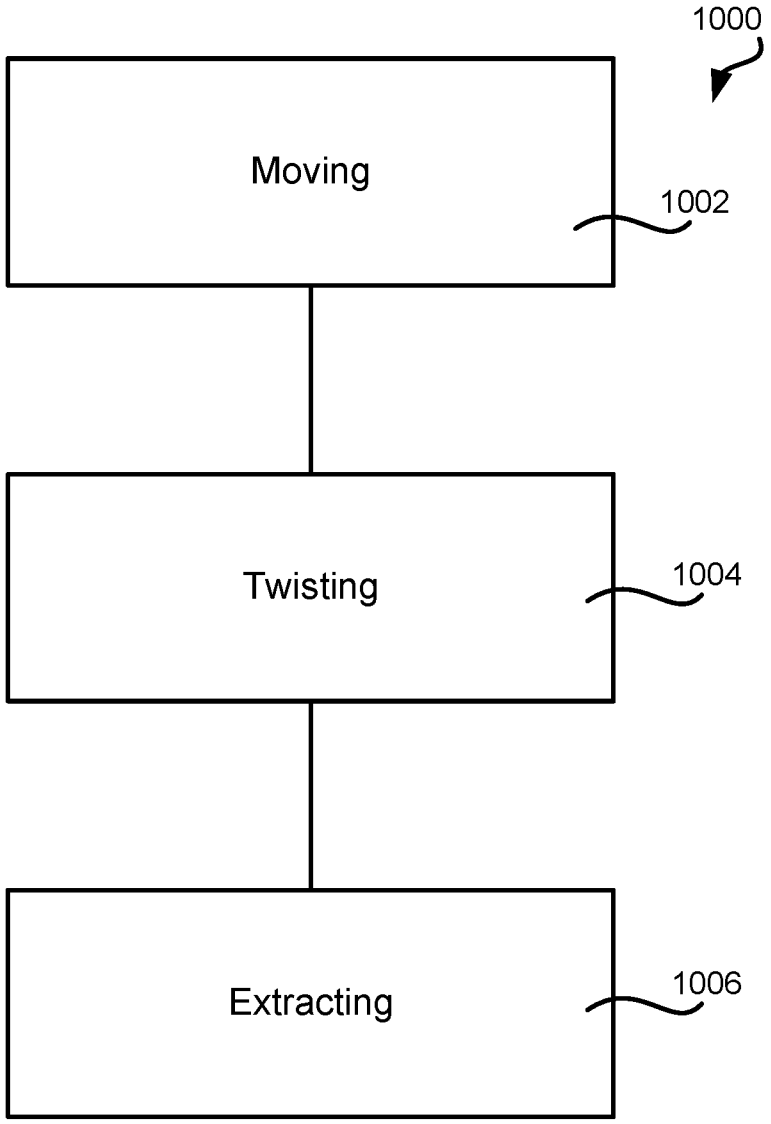
FIG. 7 discloses a flowchart of a method for dismounting a grid of profiles.

FIGS. 3 and 4 along with the flowchart outlined in FIG. 7 will in the following be used for describing an embodiment of a method 1000 for dismounting a grid of profiles 10 for a suspended ceiling system. The method 1000 comprises moving 1002 at least one of the lugs 212 to the deflected position. I.e., moving the lug 212 on the first and/or on the second secondary profile 200 into the deflected state as shown in FIG. 4. Both lugs 212 could naturally be moved to the deflected position, as mentioned. And as explained above, the step of moving 1002 could comprise moving the lug 212 to the deflected position for each the at least one of the secondary profiles 200 connected to each connection opening 102 of the primary profile 100.

The method 1000 further comprises twisting 1004 the primary profile 100 about the twisting axis A2. The twisting axis A2 is the axis around which the primary profile 100 is twisted and is typically arranged near the interface between the bottom edge of the connection opening 102 and the hook-on member 210 of the secondary profile 200 that is not dismounted/extracted.

The method further comprises extracting 1006 the hook-on member 210 of one of the first or second secondary profiles 200 out of the connection opening 102 of the primary profile 100 for disconnecting the one of the first or second secondary profile 200 from the primary profile 100.

As is illustrated in FIG. 4, moving 1002 at least one of the lugs 212 to the deflected position may comprise moving the lug 212 on the one of the first and second secondary profile 200 that is not extracted 1006 from the primary profile 100.

FIGS. 5 and 6 shows how the method 1000 outlined in the flowchart of FIG. 7 of the present disclosure may be performed for an embodiment of the grid of profiles 10 in which the lug 212 is arranged below the hook-on member 210 on the first and second secondary profile 200. For the illustrated embodiment, the method 1000 comprises moving 1002 the lug 212 to the deflected position on the one of the first and second secondary profile 200 that is extracted 1006 from the primary profile 100. The primary profile 100 is thereafter twisted 1004 to release secondary profile 200 on which the lug 212 is deflected. The secondary profile 200 can subsequently be extracted 1006 from the connection opening 102.

It will be appreciated that the present invention is not limited to the embodiments shown. Several modifications and variations are thus conceivable within the scope of the invention which thus is exclusively defined by the appended claims.

The invention claimed is:

1. A grid of profiles, comprising a primary profile having a web provided with a connection opening, and a first and second secondary profile each having an end provided with a hook-on member, wherein the first and second secondary profiles are connected to the primary profile by means of the hook-on members which are inserted into the connection opening from opposite sides thereof for hooked engagement with the web of the primary profile, wherein the first and second secondary profiles each comprises a lug extending in the longitudinal direction of the associated first or second secondary profile, which lugs cooperate with the primary profile to define a mounted state of the grid of profiles, wherein each lug is configured for deformation against the primary profile in response to a thermally induced longitudinal expansion of the associated first or second secondary profile, wherein, when the grid of profiles is set to a dismounting state, the primary profile is twistable about an axis parallel with a longitudinal direction thereof for disconnection of one of the first and second secondary profile, wherein each lug is moved to a deflected position, and wherein the grid of profiles is configured to assume the dismounting state in response to moving at least one of the lugs to the deflected position, characterized in that the lug on each of the first and second secondary profiles is configured to be moveable around a folding axis that is arranged at angle in relation to the longitudinal direction of the respective first and second secondary profile, wherein the angle is between 15° and 80°.

2. The grid of profiles according to claim 1, wherein the lug on each of the first and second secondary profiles extends at an angle in relation to the longitudinal direction of the each of the first and second secondary profile.

3. The grid of profiles according to claim 1, wherein the hook-on member on each of the first and second secondary profile comprises an upper recess configured to accommodate the primary profile as it is twisted.

4. The grid of profiles according to claim 3, wherein the upper recess at a side thereof configured to be arranged closest to the primary profile in the mounted state of the grid of profiles comprises an inclined surface.

5. The grid of profiles according to claim 1, wherein the respective lug and/or hook-on member is integrally formed with the first and second secondary profiles respectively.

6. The grid of profiles according to claim 1, wherein the lug on each of the first and second secondary profiles is configured to cooperate with a bulb portion of the primary profile to define a mounted state of the grid of profiles.

7. The grid of profiles according to claim 1, wherein the lug is arranged above the hook-on member on each of the first and second secondary profile.

8. The grid of profiles according to claim 1, wherein the lug is arranged below the hook-on member on each of the first and second secondary profile.

9. The grid of profiles according to claim 1, wherein the angle is 45°.

10. A method for dismounting a grid of profiles for a suspended ceiling system, the grid of profiles comprising a primary profile having a web provided with a connection opening, and a first and a second secondary profiles each having an end provided with a hook-on member, wherein the first and second secondary profiles are connected to the primary profile by means of the hook-on members which are inserted into the connection opening from opposite sides thereof for hooked engagement with the web of the primary profile, wherein the first and second secondary profiles each comprises a lug extending in the longitudinal direction of the associated first or second secondary profile, which lugs cooperate with the primary profile to define a mounted state of the grid of profiles, wherein each lug is configured for deformation against the primary profile in response to a thermally induced longitudinal expansion of the associated first or second secondary profile, wherein the grid of profiles is settable to a dismounting state in which the primary profile is twistable about an twisting axis parallel with a longitudinal direction thereof for disconnection of one of the first or second secondary profile, and wherein each lug is movable to a deflected position, the method comprising moving at least one of the lugs to the deflected position, twisting the primary profile about the twisting axis, and extracting the hook-on member of one of the first or second secondary profiles out of the connection opening of the primary profile for disconnecting the one of the first or second secondary profile from the primary profile.

11. The method for dismounting a grid of profiles for a suspended ceiling system according to claim 10, wherein moving at least one of the lugs to the deflected position comprises moving the lug on the one of the first and second secondary profile that is extracted from the primary profile.

12. The method for dismounting a grid of profiles for a suspended ceiling system according to claim 10, wherein moving at least one of the lugs to the deflected position comprises moving the lug on the one of the first and second secondary profile that is not extracted from the primary profile.

13. The method for dismounting a grid of profiles for a suspended ceiling system according to claim 10, wherein moving at least one of the lugs to the deflected position comprises moving the lug around a folding axis being arranged at angle in relation to the longitudinal direction of the respective first and second secondary profile, wherein the angle is between 15° and 80°.

14. The method for dismounting a grid of profiles according to claim 13, wherein the angle is 45°.

15. The method for dismounting a grid of profiles according to claim 10, wherein the grid of profiles is set to the dismounting state in which the primary profile is twistable about the twisting axis.

16. The method for dismounting a grid of profiles according to claim 14, wherein the angle allows the primary profile to be twisted to a larger degree before a bulb portion of the primary profile abuts against the deflected lug, thereby facilitating the twisting and dismounting of the primary profile.

* * * * *